US008449213B2

(12) United States Patent
Chang

(10) Patent No.: US 8,449,213 B2
(45) Date of Patent: May 28, 2013

(54) EYELINER APPLICATOR

(76) Inventor: Ching-Tse Chang, Taichung (TW)

( * ) Notice: Subject to any disclaimer, the term of this patent is extended or adjusted under 35 U.S.C. 154(b) by 38 days.

(21) Appl. No.: 13/297,138

(22) Filed: Nov. 15, 2011

(65) Prior Publication Data

US 2012/0141187 A1 Jun. 7, 2012

(30) Foreign Application Priority Data

Dec. 3, 2010 (TW) ..... 99142049 A

(51) Int. Cl.
*B43K 5/00* (2006.01)

(52) U.S. Cl.
USPC ..... 401/205; 401/202; 401/199

(58) Field of Classification Search
USPC .. 401/198, 199, 202, 205, 263, 264; 215/254, 215/255, 256
See application file for complete search history.

(56) References Cited

U.S. PATENT DOCUMENTS

| | | | | |
|---|---|---|---|---|
| 4,588,319 | A * | 5/1986 | Niemeyer | 401/205 |
| 5,082,386 | A * | 1/1992 | Hironaka et al. | 401/206 |
| 6,406,205 | B1 * | 6/2002 | Hu | 401/205 |
| 7,073,967 | B2 * | 7/2006 | Choi et al. | 401/199 |
| 7,182,541 | B1 * | 2/2007 | Ziniti et al. | 401/206 |

* cited by examiner

*Primary Examiner* — David Walczak

(57) ABSTRACT

An eyeliner applicator includes a pen tube, a bead, a connecting tube, a first water-absorbed member, a second water-absorbed member, a fixing means, and a retainer ring. The connecting tube has an applicator body, a pushing portion, a passage, an outer surface, and at least an abutting member. The passage comprises an upper section and a lower section. The first water-absorbed member is disposed in the upper section of the passage. The second water-absorbed member is disposed in the lower section of the passage. A density of the first water-absorbed member is greater than a density of the second water-absorbed member. The abutting member is disposed on the outer surface of the connecting tube. The retainer ring detachably clasps the outer surface. The applicator can prevent the water of ink from vaporizing and the water-absorbed members from absorbing much ink.

7 Claims, 4 Drawing Sheets

EYELINER APPLICATOR

BACKGROUND OF THE INVENTION

1. Field of the Invention

The present invention relates to an eyeliner applicator which includes ink.

2. Description of the Prior Art

There are two kinds of eyeliner applicators, ones contain ink, the others include a pencil. The eyeliner applicator containing ink has an applicator body, which absorbs full of ink. Users can put the ink on their eyeliners with the applicator body.

However, when conventional eyeliner applicators containing ink manufacture and pack in a factory, the water of ink always vaporize through gaps to the air, though the eyeliner applicators are covered by caps. Before the eyeliner applicators are unpacked, the water of ink has already vaporized into air during transit or on sale. The concentration of ink would be enhanced, so that the ink would be viscous or dry. After consumers buy conventional eyeliner applicators and unpack them, they will discover the amount and the concentration of ink different from the information in the label.

In view of the foregoing, a conventional eyeliner applicator is disclosed in TW M288127. The eyeliner applicator has a water-absorbed member, an ink regulator, and a steel ball. The water-absorbed member is disposed in a channel of the ink regulator. When users unpack it and want to use it, they have to push the ink regulator first. Thereafter, one end of the ink regulator will push the steel ball into a limiting plug. At the present time, the ink can flow through the plug, and the water-absorbed member can absorb the ink. However, the water-absorbed member always absorbs too much ink so that it is supersaturated. The situation results in the ink leak out of the applicator body.

Another conventional eyeliner applicator is disclosed in U.S. Pat. No. 6,997,631. The eyeliner applicator has three water-absorbed members which are difference between their density. The highest density one is the closest to the applicator body. The lowest density one is the furthest to the applicator body. As a result, this eyeliner applicator can prevent the applicator body from absorbing much ink, and further improve the problem that the ink leaks out of the applicator body. However, this conventional eyeliner applicator still has a problem that the water of ink always vaporizes through gaps to the air.

The present invention is, therefore, arisen to obviate or at least mitigate the above mentioned disadvantages.

SUMMARY OF THE INVENTION

The main object of the present invention is to provide an eyeliner applicator which prevents the water of ink from vaporizing before unpacking and the water-absorbed members from absorbing much ink and being supersaturated.

To achieve the above, an eyeliner applicator of the present invention comprises a pen tube, a bead, a connecting tube, a first water-absorbed member, a second water-absorbed member, a fixing means, and a retainer ring.

The pen tube is formed with a first receiving space. The first receiving space has an opening. The pen tube comprises an interior surface. The interior surface has an abutting portion. The abutting portion has a through hole.

The bead is lodged in the through hole.

The connecting tube is slidably inserted in one end of the pen tube. The connecting tube has an applicator body, a pushing portion, a passage, an outer surface, and at least an abutting member. The passage comprises an upper section and a lower section. The passage penetrates the applicator body and the pushing portion. The upper section of the passage penetrates the applicator body. The lower section of the passage penetrates the pushing portion. The passage communicates with the through hole. The pushing portion is located at a bottom of the connecting tube. The pushing portion is a hard object. The abutting member is disposed on the outer surface of the connecting tube.

The first water-absorbed member is disposed in the upper section of the passage. The first water-absorbed member is capillary material.

The second water-absorbed member is disposed in the lower section of the passage. The second water-absorbed member is capillary material.

Wherein a density of the first water-absorbed member is greater than a density of the second water-absorbed member.

The fixing means for selectably fixing the connecting tube on the pen tube.

The retainer ring detachably surrounds and clasps the outer surface of the connecting tube. The retainer ring is located between an opening of the pen tube and the abutting member.

Wherein the connecting tube is capable of moving between a first position and a second position. The pushing portion selectably inserts into the through hole. When the retainer ring is removed from the connecting tube, the abutting member is abutted on an edge of the opening of the pen tube, and the connecting tube is located in the second position. The pushing portion pushes the bead, so that the bead is separated from the abutting portion, and the connecting tube is fixed on the pen tube.

Before the eyeliner applicator of the present invention is unpacked, the bead is lodged in the through hole, so that the ink would not flow out from the first receiving space, whereby the water of ink does not vaporize completely.

After consumers unpack the package in which the present invention is packed, they push the pushing portion, and then the pushing portion pushes the bead away from the through hole. The ink can flow into the through hole. At the moment, the second water-absorbed member absorbs the ink. Besides, the first and second water-absorbed members are capillary material. The ink includes large particles and small particles. When the ink flows through the second water-absorbed member, the large particles are lodged in pores of the second water-absorbed member. Whereby the present invention controls the flow rate of ink through the second water-absorbed member. The first water-absorbed member is not blocked by the large particles of ink and does not absorb much ink so as to prevent the ink from leaking out of the applicator body constantly.

In addition, the pushing portion can not only push the bead, but also receive the second water-absorbed member therein. As a result, the present invention is convenient to use and installation.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
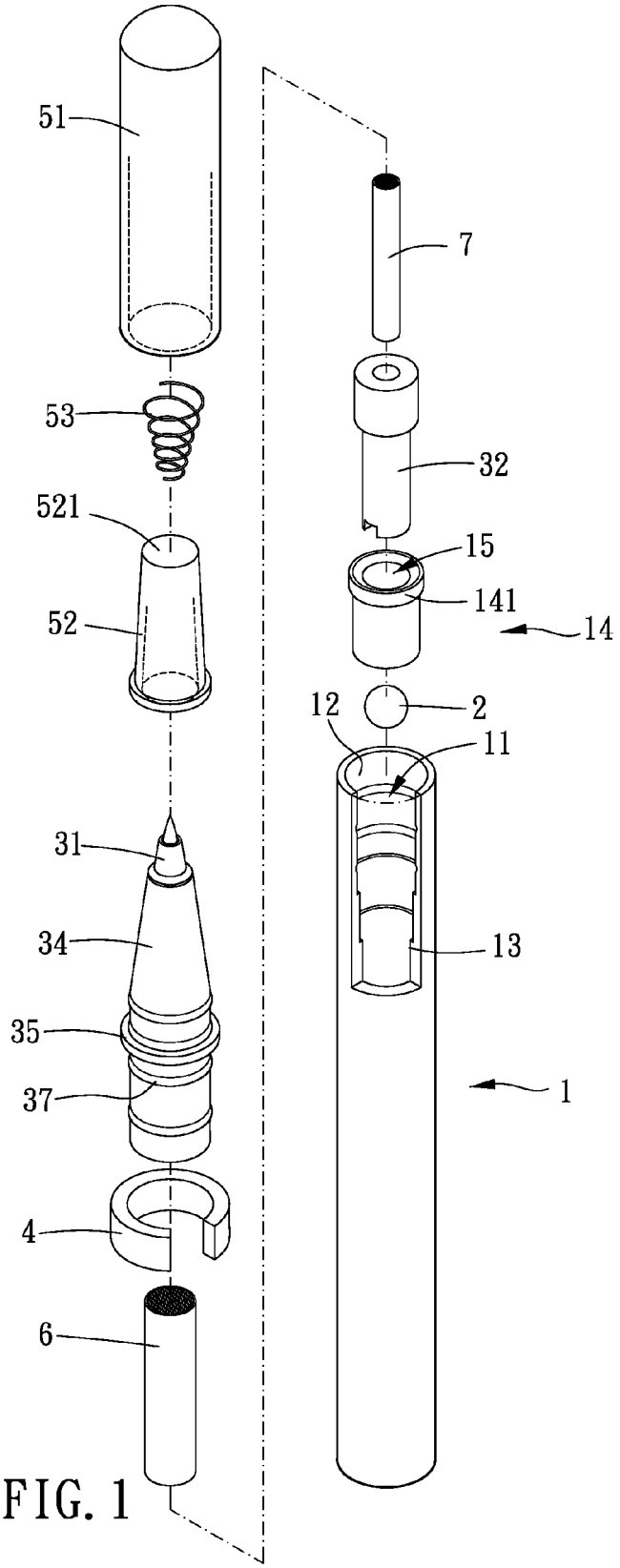
FIG. 1 is a breakdown drawing showing the present invention.
Figure 2A:
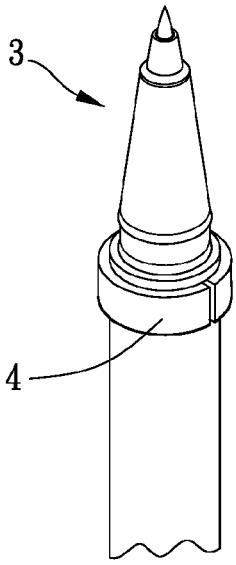
FIG. 2A is a schematic drawing showing that the retainer ring surrounds and clasps the connecting tube.
Figure 2B:
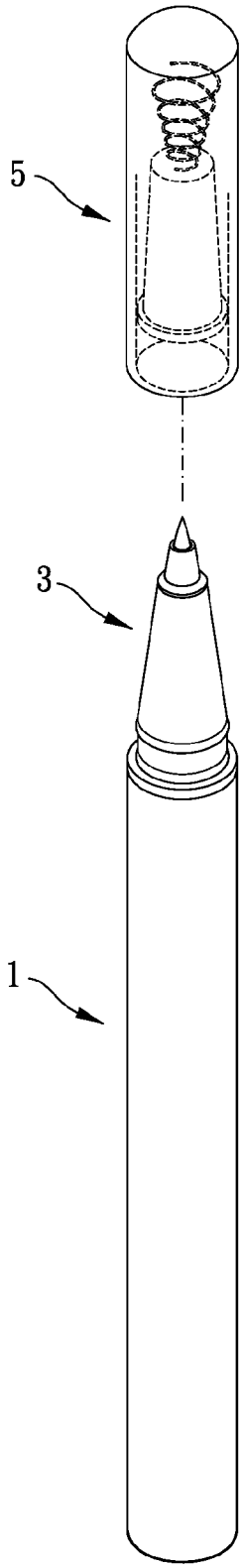
FIG. 2B is a schematic drawing showing that the retainer ring is removed from the connecting tube.
Figure 3:
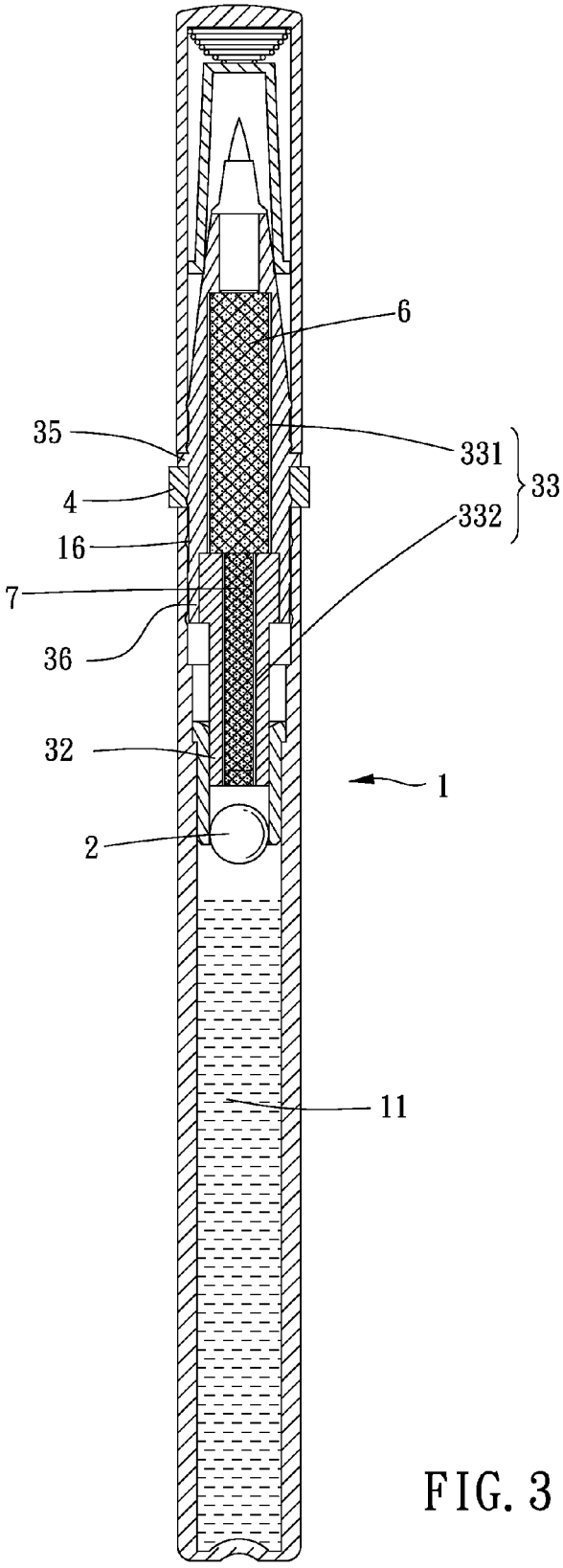
FIG. 3 is a profile of the present invention, wherein the retainer ring surrounds and clasps the outer surface of the connecting tube and is located between the edge of the opening of the pen tube and the abutting member.

Please refer to FIG. 1, FIG. 2, and FIG. 3. The preferable embodiment of the present invention comprises a pen tube 1, a bead 2, a connecting tube 3, a fixing means, a retainer ring 4, a cap 5, a first water-absorbed member 6, and a second water-absorbed member 7.

The pen tube 1 is formed with a first receiving space 11 which has an opening. The receiving space 11 is adapted for containing liquid, such as ink. The pen tube 1 comprises an interior surface 12 which has an abutting portion. In the present embodiment, the abutting portion comprises an annular flange 13, a cylinder 14, and a through hole 15. The annular flange 13 is disposed on the interior surface 12. The cylinder 14 comprises a circular portion 141 which abuts the annular flange 13. The through hole penetrates the cylinder 14. In other embodiments, the annular flange and the cylinder are formed integrally. Also, the abutting portion merely comprises the annular flange 13 and the through hole 15, and the through hole 15 penetrates the annular flange 13. In another embodiment (not shown), the pen tube 1 comprises an inner tube disposed in the first receiving space 11. The inner tube is formed with a second receiving space. More plainly, in this embodiment the second receiving space substitutes for the first receiving space, which contains ink.

Figure 4:
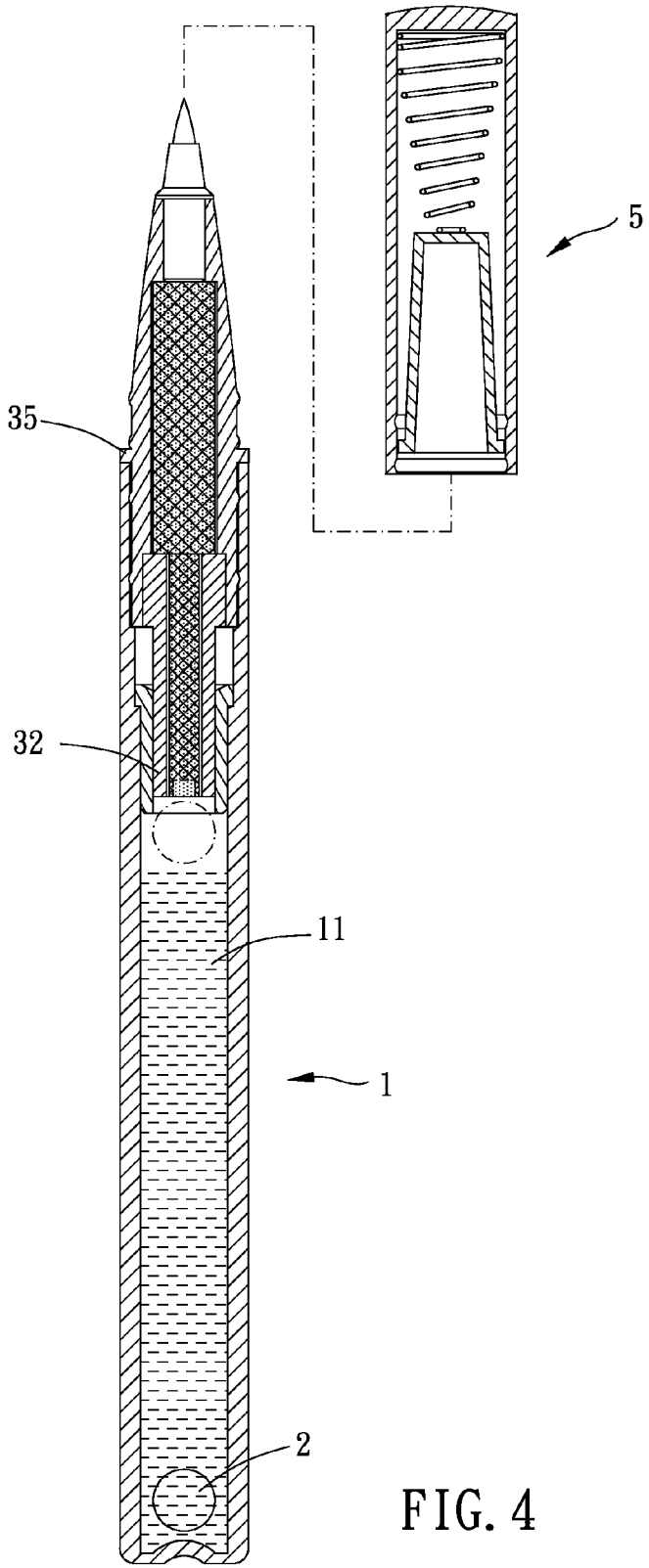
FIG. 4 is a profile showing the retainer being removed, wherein the bead is separated from the abutting portion.

Please refer to FIG. 1, FIG. 3, and FIG. 4. The bead 2 is lodged in the through hole 15. Preferably, the bead is a steel ball. In other embodiments, the bead is made of any material as well.

The connecting tube 3 is slidably inserted in one end of the pen tube 1. The connecting tube 3 has an applicator body 31, a pushing portion 32, a passage 33, an outer surface 34, and at least an abutting member 35. The passage 33 comprises an upper section 331 and a lower section 332. The passage 33 penetrates the applicator body 31 and the pushing portion 32. More specifically, the upper section 331 of the passage penetrates the applicator body 31 and the lower section 332 of the passage penetrates the pushing portion 32. The passage communicates with the through hole 15. The pushing portion 32 located at a bottom of the connecting tube 3 is a hard object. The abutting member 35 is disposed on the outer surface 34 of the connecting tube.

The retainer ring 4 detachably surrounding and clasping the outer surface 34 of the connecting tube is located between an opening of the pen tube 1 and the abutting member 35. In this embodiment, the bottom of the connecting tube includes a connecting portion 36. One end of the pushing portion 32 is detachably fixed in the connecting portion 36, the other end of the pushing portion 32 extends away from the applicator body 31. In this embodiment, the connecting portion is a recess. One end of the pushing portion 32 inserts into the recess. In other embodiments, the connecting portion 36 and the pushing portion 32 are formed integrally as well. The abutting member 35 is a circular block circling the outer surface 34 of the connecting tube. In other embodiments, the abutting member 35 includes a plurality of blocks circling the outer surface 34 of the connecting tube.

The fixing means for selectably fixing the connecting tube 3 on the pen tube 1. Preferably, as shown in FIG. 1, FIG. 3, and FIG. 4, the connecting tube 3 further includes a fixing portion 37 disposed on the outer surface 34 of the connecting tube. The pen tube includes a limiting portion 16 disposed on the interior surface 12. In this embodiment, the fixing portion 37 is a bump, and the limiting portion 16 is a recess. The bump is lodged in the recess. In other embodiments, the fixing portion 37 is a recess, and the limiting portion 16 is a bump. Or the fixing portion 37 is formed with an external screw thread, the limiting portion 16 is formed with an internal screw thread, so that the fixing portion 37 is threaded into the limiting portion 16.

The cap 5 includes an outer cap 51, an inner cap 52, and a spring 53. The outer cap 51 covers the connecting tube 3. The inner cap 52 is disposed in the outer cap 51. The spring 53 is disposed in the outer cap 51. Preferably, an inner diameter of the outer cap 51 is wider than an inner diameter of the inner cap 52. The outer cap 51 includes an internal top surface. The inner cap 52 includes an external top surface 521. One end of the spring 53 is disposed on the internal top surface of the outer cap, the other end of the spring 53 is disposed on the external top surface 521 of the inner cap. The spring 53 provides an elastic force to the inner cap 52 so that the inner cap 52 would move toward an original position at any time.

Please refer to FIG. 2A to FIG. 4. Wherein the connecting tube 3 is capable of moving between a first position and a second position, the pushing portion 32 selectably inserts into the through hole 15. When consumers remove the retainer ring 4 from the connecting tube 3, the abutting member 35 is abutted on an edge of the opening of the pen tube 1, and the connecting tube 3 is located in the second position, as shown in FIG. 2 and FIG. 4. The pushing portion pushes the bead 2 so that the bead is separated from the through hole 15 of the abutting portion, and then the connecting tube 3 is fixed on the pen tube 1. More specifically, as shown in FIG. 4, the bead 2 drops into the first receiving space 11. The ink can flow through the through hole 15 and the passage 33, and finally flow in the applicator body 31. The fixing portion 37 is fixed with the limiting portion 16.

The first water-absorbed member 6 is disposed in the upper section 331. The second water-absorbed member 7 is disposed in the lower section 332. More specifically, the second water-absorbed member 7 is inside of the pushing portion 32. In other words, the hard pushing portion 32 can not only push the bead 2, but also receive the second water-absorbed member 7 therein. As a result, the present invention is convenient to use and installation. The first and second water-absorbed member 6, 7 are capillary material, such as cotton or diffuser. In briefly, when the bead has dropped into the first receiving space and the eyeliner applicator is upside down or inclined, the second water-absorbed member can't touch the ink (not shown), the first and second water-absorbed members still transport a ration of ink into the applicator body.

Furthermore, a density of the first water-absorbed member 6 is greater than a density of the second water-absorbed member 7. If manufacturers use pigment as ink, the large particles of ink would be lodged in pores when the ink flows through the second water-absorbed member 7. Preferably, a diameter of the upper section 331 of the passage is greater than a diameter of the lower section 332 of the passage, and a diameter of the first water-absorbed member 6 is greater than a diameter of the second water-absorbed member 7, so that the volume ratio of the first water-absorbed member to the second water-absorbed member can keep better always. Whereby the present invention can control the flow rate of ink through the second water-absorbed member 7. At the same time, the pigment can only flow along the gaps between particles. The first water-absorbed member 6 is not blocked by the large particles of the pigment. The saturation of the first water-absorbed member 6 is controlled so as not to absorb too much pigment and prevent the pigment from leaking out of the applicator body 31. Any manner of maintaining the volume ratio of the first water-absorbed member to the second water-absorbed member in the better ratio can achieve the same function, such as changing their length, width, or both.

Before the eyeliner applicator of the present invention is unpacked, the bead is lodged in the through hole, so that the ink would not flow out from the first receiving space, whereby the water of ink does not vaporize completely. After consumers remove the retainer ring, the amount and the concentration of ink still match up with the information in the label. And then the pushing portion pushes the bead 2 so that the bead is separated from the through hole 15 of the abutting portion. The second water-absorbed member absorbs the ink. Consumers can apply the ink on their eyeliners.

If the installing machine or workers make a mistake in the installation process, it could have the bead slide into the first receiving space so as to cause the bead to lose its function, which is to prevent the ink flow out of the receiving space before the retainer removing. To this end, the present invention can directly avoid the bead sliding to the first receiving space. First of all, the bead 2 is lodged in the through hole 15 of the cylinder 14. Secondly, put the cylinder 14 into the pen tube 1, and put the circular portion 141 abuts on the annular flange 13. Whereby the bead does not drop completely before consumers push the pushing portion.

Moreover, the volume ratio of the first water-absorbed member to the second water-absorbed member can keep better always, so as to prevent the first water-absorbed member from absorbing too much ink and being supersaturated.

Additionally, when consumers use the present invention a period of time, all pores of the second water-absorbed member would be blocked by the pigment particles. The flow rate would be reduced. At the moment, consumers can take a new second water-absorbed member instead of the old one. There is no need to change all water-absorbed members. Whereby consumers can save much money to change the water-absorbed members.

In view of the foregoing, the present invention of the eyeliner applicator prevents the water of ink from vaporizing before unpacking and the water-absorbed members from absorbing much ink and being supersaturated.

What is claimed is:

1. An eyeliner applicator, comprising:

a pen tube, formed with a first receiving space, the first receiving space having an opening, the pen tube comprising an interior surface, the interior surface having an abutting portion, the abutting portion having a through hole;

a bead, lodged in the through hole;

a connecting tube, slidably inserted in one end of the pen tube, the connecting tube having an applicator body, a pushing portion, a passage, an outer surface, and at least an abutting member, the passage comprising an upper section and a lower section, the passage penetrating the applicator body and the pushing portion, the upper section of the passage penetrating the applicator body, the lower section of the passage penetrating the pushing portion, the passage communicating with the through hole, the pushing portion being located at a bottom of the connecting tube, the pushing portion being a hard object, the abutting member being disposed on the outer surface of the connecting tube;

a first water-absorbed member, disposed in the upper section of the passage, the first water-absorbed member being capillary material;

a second water-absorbed member, disposed in the lower section of the passage, the second water-absorbed member being capillary material;

wherein a density of the first water-absorbed member is greater than a density of the second water-absorbed member;

a fixing means for selectably fixing the connecting tube on the pen tube;

a retainer ring, detachably surrounding and clasping the outer surface of the connecting tube, the retainer ring being located between an opening of the pen tube and the abutting member;

wherein the connecting tube is capable of moving between a first position and a second position, the pushing portion selectably inserts into the through hole, when the retainer ring is removed from the connecting tube, the abutting member is abutted on an edge of the opening of the pen tube, and the connecting tube is located in the second position, the pushing portion pushes the bead, so that the bead is separated from the abutting portion, and the connecting tube is fixed on the pen tube.

2. The eyeliner applicator of claim 1, further comprising an outer cap, an inner cap, and a spring, the outer cap covering the connecting tube, the inner cap being disposed in the outer cap, the spring being disposed in the outer cap, the spring providing an elastic force to the inner cap, so that the inner cap would move toward an original position at any time.

3. The eyeliner applicator of claim 1, wherein a diameter of the first water-absorbed member is greater than a diameter of the second water-absorbed member.

4. The eyeliner applicator of claim 1, wherein the first and second water-absorbed members are diffusers.

5. The eyeliner applicator of claim 1, wherein the abutting portion comprises an annular flange and a cylinder, the annular flange is disposed on the interior surface, the cylinder comprises a circular portion, the circular portion abuts the annular flange, the through hole penetrates the cylinder.

6. The eyeliner applicator of claim 1, wherein the bottom of the connecting tube comprises a connecting portion, one end of the pushing portion is detachably fixed in the connecting portion, the other end of the pushing portion extends away from the applicator body.

7. The eyeliner applicator of claim 1, wherein the pen tube comprises an inner tube, the inner tube is disposed in the first receiving space, the inner tube is formed with a second receiving space.

* * * * *